US005813618A

United States Patent [19]

Prew

[11] Patent Number: 5,813,618

[45] Date of Patent: Sep. 29, 1998

[54] CONTINUOUS CYCLINDRICAL WOOD PULP REFINER

[75] Inventor: Stanley R. Prew, Williamsport, Pa.

[73] Assignee: Andritz Sprout-Bauer, Inc., Muncy, Pa.

[21] Appl. No.: 563,773

[22] Filed: Nov. 28, 1995

[51] Int. Cl.[6] ..... B02C 19/00

[52] U.S. Cl. ..... 241/259.1; 241/260

[58] Field of Search ..... 241/28, 21, 285.1, 241/285.2, 285.3, 259.1, 259.2, 261.1, 260

[56] References Cited

U.S. PATENT DOCUMENTS

| | | | |
|---|---|---|---|
| 1,718,184 | 6/1929 | Ostermann | 241/261.1 X |
| 1,951,519 | 3/1934 | Milne . | |
| 3,547,356 | 12/1970 | Asplund . | |
| 4,199,114 | 4/1980 | Asplund . | |
| 4,614,304 | 9/1986 | Reinhall et al. . | |
| 4,688,727 | 8/1987 | Sijsling | 241/261.1 X |
| 5,148,994 | 9/1992 | Haider et al. | 241/261.1 |
| 5,269,471 | 12/1993 | Yamagishi | 241/261.1 X |

FOREIGN PATENT DOCUMENTS

| | | | |
|---|---|---|---|
| 1217754 | 5/1966 | Germany | 241/261.1 |

*Primary Examiner*—Mark Rosenbaum

*Attorney, Agent, or Firm*—Alix, Yale & Ristas, LLP

[57] ABSTRACT

A continuous cylindrical wood pulp refiner comprising a rotor disposed in a housing having a plurality of structural members. At least one refining plate is mounted to a holder portion of each member such that the entire periphery of the rotor is exposed to refining plates. The pulp to be refined continuously flows axially along the periphery of the rotor. The members define two shells which are pivotally mounted to the refiner base such that the shells may be pivoted away from each other to provide access to the interior surface for changing the refiner plates. Each holder portion has a pair of bores which are parallel to the axis of the rotor. A cam portion of a cam shaft is disposed in each bore. Rotating the cam shaft causes the cam portion to engage the surface of the bore thereby moving the holder portion radially towards or away from the rotor whereby the gap between the refining plates and the rotor can be adjusted. A gear is mounted on an end portion of each cam shaft which extends longitudinally outward through an orifice in the housing. First and second chains engage each gear mounted to the cam shafts which are disposed in the first and second shells, respectively. One of the gears mounted on a cam shaft disposed in the first shell engages one of the gears mounted on a cam shaft disposed in the second shell. A gear motor actuates movement of one of the chains wherein the movement of all of the cam shafts is coordinated to synchronize movement of all of the holders to uniformly adjust the gap.

20 Claims, 8 Drawing Sheets

CONTINUOUS CYCLINDRICAL WOOD PULP REFINER

BACKGROUND OF THE INVENTION

This invention relates generally to apparatus for refining wood pulp. More particularly, the present invention relates to low intensity apparatus for refining wood pulp.

High strength, high quality paper is generally produced in a process which follows so-called "low intensity" refining of pulp. Low intensity cylindrical refiners, generally referred to as "beaters," were utilized to produce pulp until the 1960's. The beaters had a roll with transverse bars at the outside diameter located on one side of a donut-shaped tank. Up to three bed-plates with bars on the contacting surface opposed the roll, covering 60–70 degrees of the roll near the bottom of the tank. The tank was filled with water and raw material, typically rags and wood pulp mixtures. The water/pulp mass was circulated by the roll, as it refined the pulp, until the desired pulp properties were achieved. This process required the material to make multiple passes through the refining zone. Consequently, the process could take several hours and only operated in a batch mode.

Current low intensity, high efficiency wood pulp refiners utilize a variety of manufacturing methods. Such methods attempt to maximize the refining surface area and to minimize "no-load". Increased surface area increases the capability of the refiner to apply power and also reduces the intensity of the action upon the fiber, preserving strength properties while still developing or fibrillating the fiber for good bonding strength in a paper sheet. No-load is the power required to spin the rotating parts in liquid medium without a narrow enough plate gap to develop the fiber.

One particular method uses oversized twin rotating disks. In order to increase the refining surface area of such refiners, the diameter of the refiner must be increased significantly. Since no-load is a function of diameter to the fifth power and speed cubed, the speed of the machine must be decreased significantly at larger diameters to decrease the no-load pumping energy to the point where a significant amount of energy can be applied to actually refining the wood fiber itself.

Another method is to use a conical refiner where the amount of refining surface area can be increased over a flat disk having the same outside diameter. However, due to the reduced maximum diameter of the rotating surface for the same refining surface area as a flat disk, the open cross sectional flow area at the discharge from the refining zone is significantly reduced. This limits the volummetric capacity of the machine. In order to maintain the volummetric capacity with this limit in discharge cross section, the open flow area within the refining plates themselves must be increased. This limits the number of bars in the plates, increasing the intensity of the action upon the fibers. In addition, the effective depth of the grooves on the refiner plate is limited thereby limiting the life of the refiner plate. If the grooves are too deep, oversize particles of pulp will be discharged from the refiner. Limiting the depth of the grooves limits the size of the output pulp particles but also limits the height of the bars defined by the grooves. Consequently, the refiner plate must be changed more frequently due to mechanical erosion of the bars.

SUMMARY OF THE INVENTION

Briefly stated, the present invention in a preferred form is a continuous cylindrical wood pulp refiner which comprises a substantially cylindrical rotor disposed in a radially adjustable housing. The rotor is mounted to a shaft which is driven at one or both ends in a conventional manner for rotation about an axis.

The housing is comprised of a plurality of structural members. The members are mounted together to define a pair of shells. Each member has a pair of wedge-shaped positioning members and an axially movable holder portion. Packing, O-rings or other suitable means are employed to seal the holder portion to the positioning members. At least one refining plate is mounted to each holder portion, whereby the entire periphery of the rotor is exposed to the refining plates. Each shell is pivotally mounted to the refiner base such that the shells may be pivoted away from each other to provide access to the interior surface for changing the refiner plates.

The refining gap between the housing and the rotor can be adjusted. In a preferred embodiment, each holder portion has a pair of bores which are parallel to the shaft axis and adjacent to an end of the holder. The cam portion of a cam shaft is disposed in each bore. Rotating the cam shaft causes the cam portion to engage the surface of the bore thereby moving the holder towards or away from the rotor.

A toothed gear is mounted on an end portion of each cam shaft which extends longitudinally outward through an orifice in the housing. First and second chains engage each gear of those cam shafts which are disposed in the first and second shells, respectively. One of the gears mounted on a cam shaft disposed in the first shell engages one of the gears mounted on a cam shaft disposed in the second shell. A gear motor actuates movement of one of the chains wherein the movement of all of the cam shafts is coordinated to synchronize movement of all of the holders to uniformly adjust the gap.

It is an object of the invention to provide a new and improved low intensity refiner for wood pulp.

It is another object of the invention to provide a new and improved low intensity refiner for wood pulp which is more efficient than existing low intensity refiners.

It is a further object of the invention to provide a new and improved cylindrical refiner for wood pulp that operates continuously.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
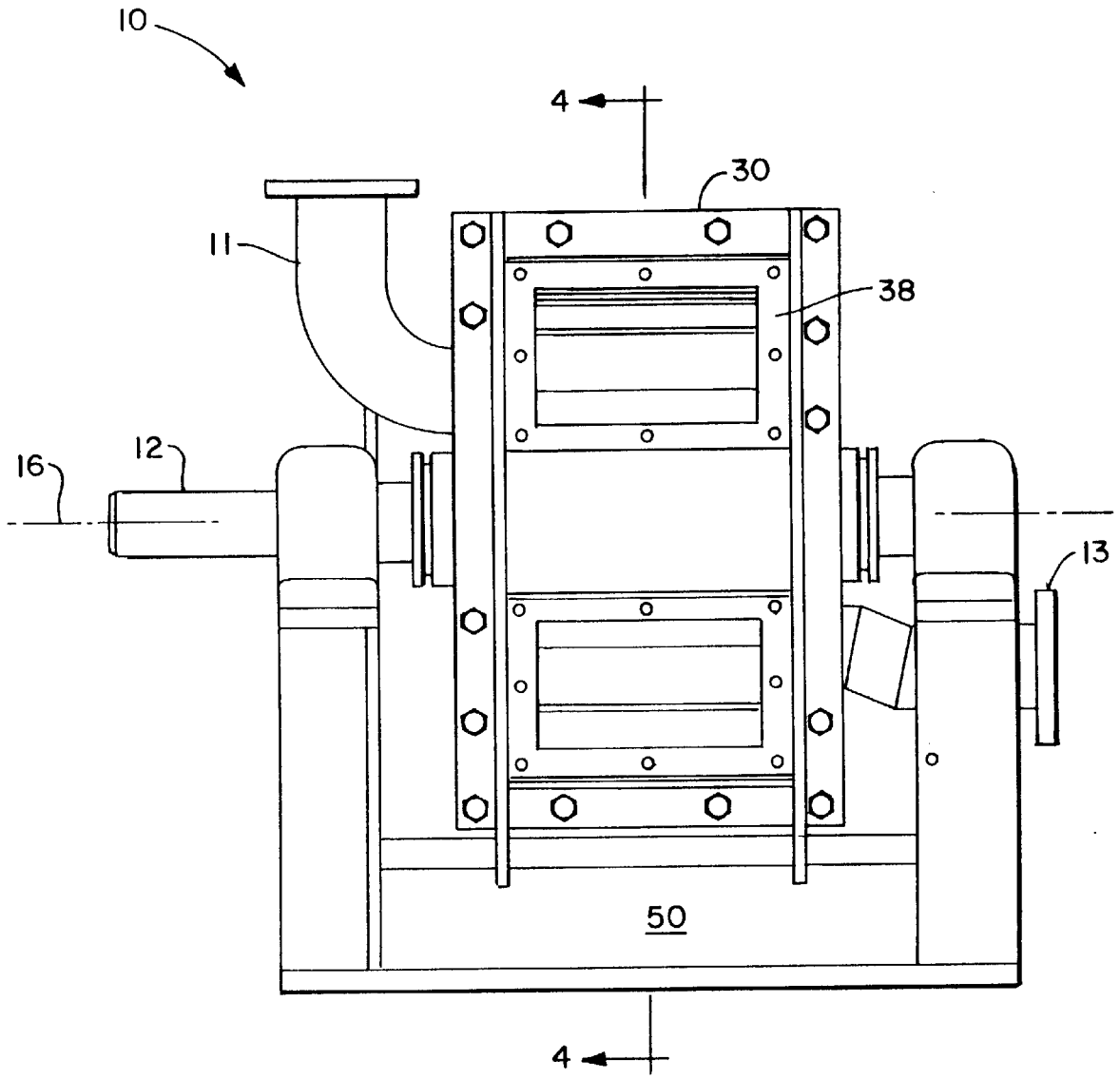
FIG. 1 is a side elevation view of a continuous cylindrical wood pulp refiner in accordance with the invention.
Figure 2:
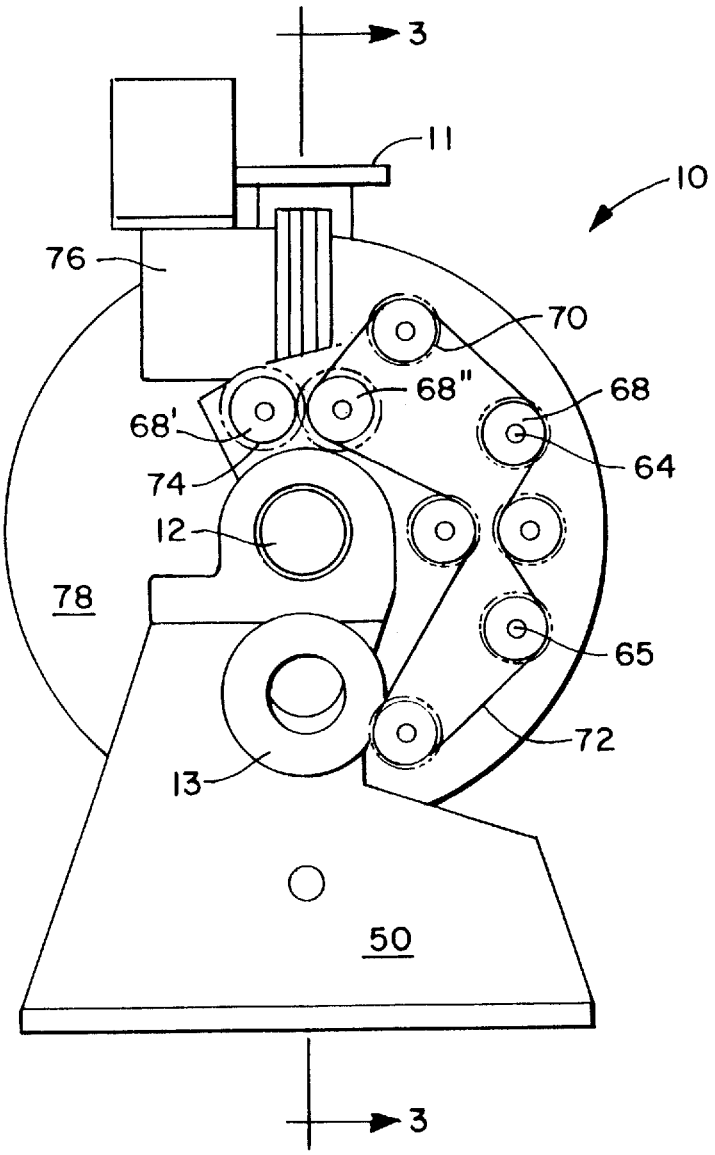
FIG. 2 is a front view, partly in phantom, of the continuous cylindrical wood pulp refiner of FIG. 1.
Figure 3:
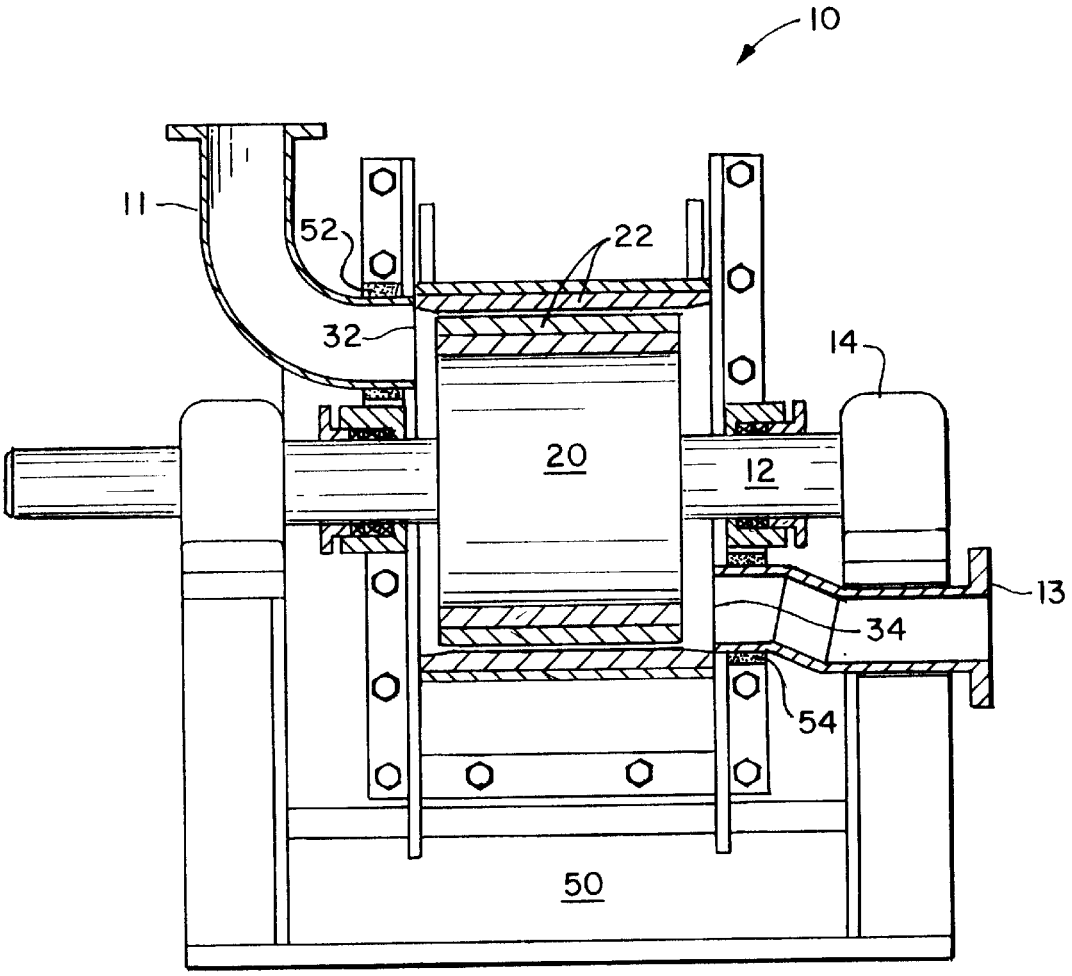
FIG. 3 is a cross section view of the continuous cylindrical wood pulp refiner of FIG. 1 taken through line 3—3 of FIG. 2.
Figure 4:
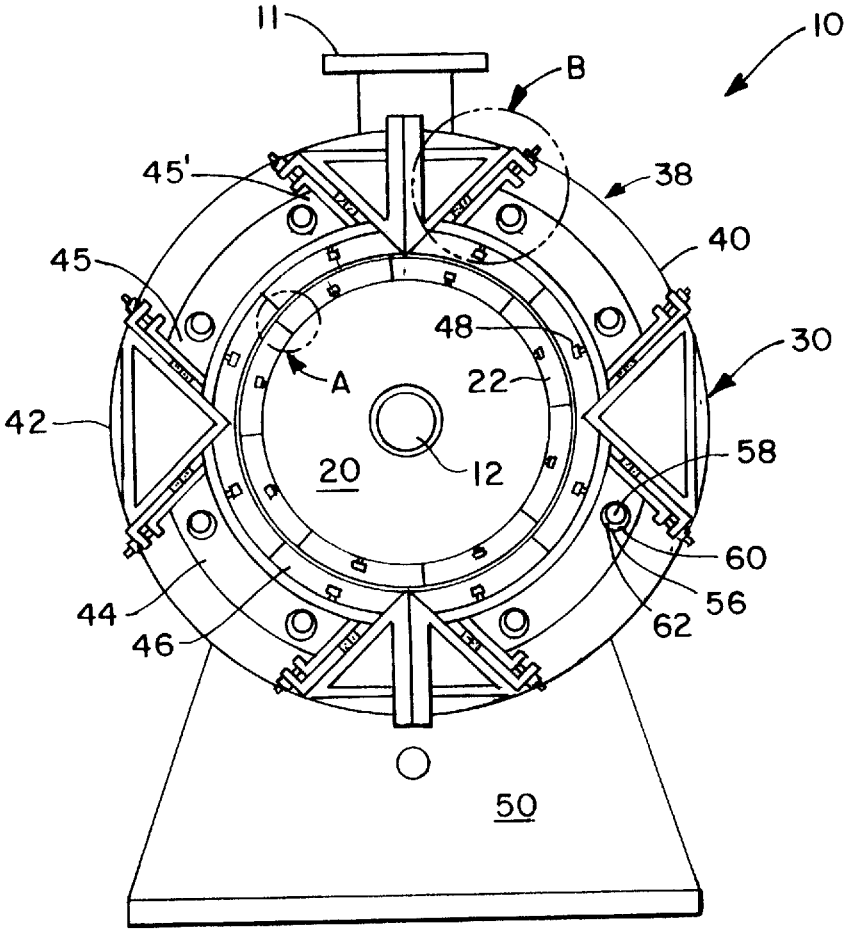
FIG. 4 is a cross section view of the continuous cylindrical wood pulp refiner of FIG. 1 taken through line 4—4 of FIG. 1.
Figure 5:
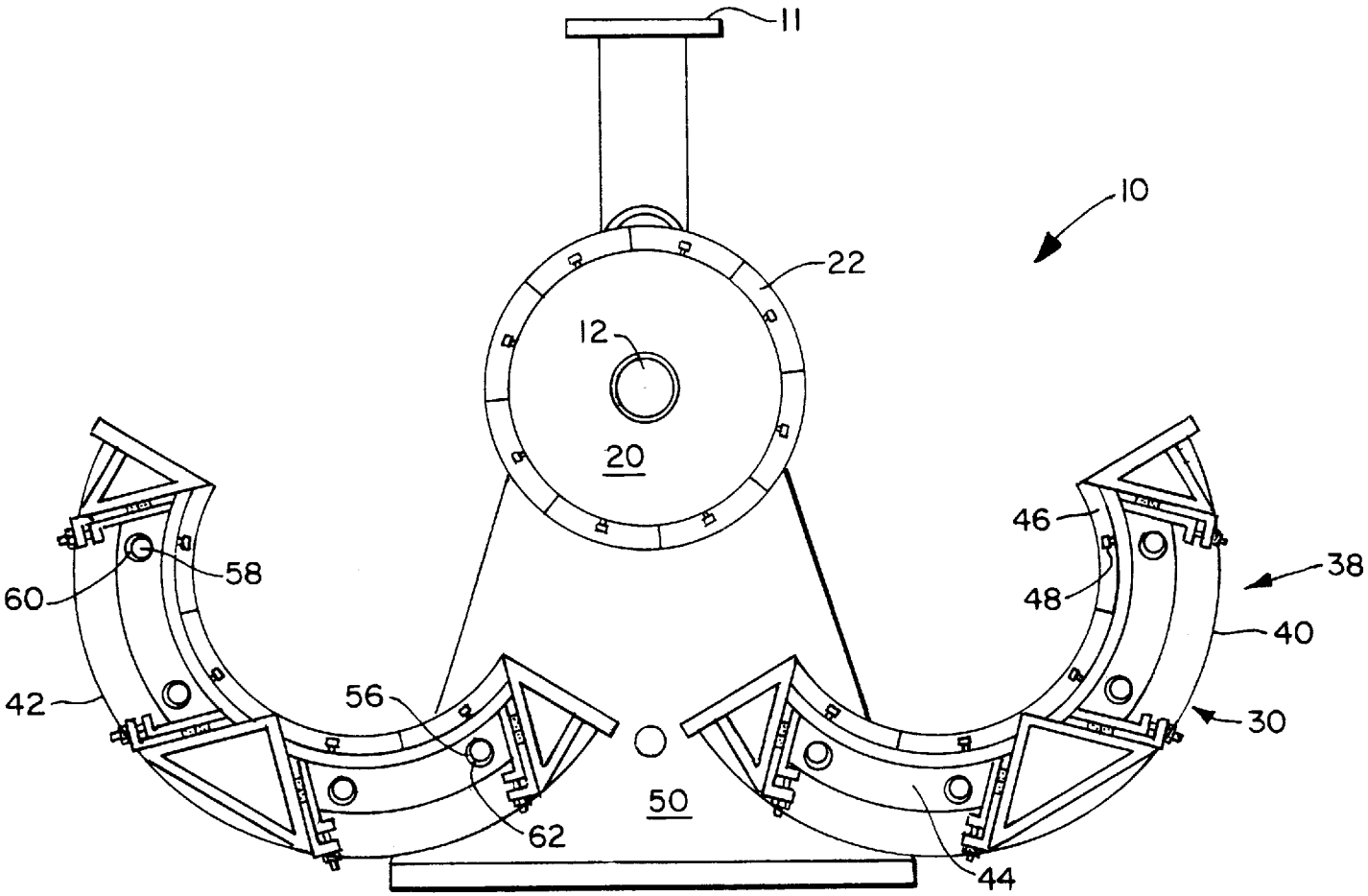
FIG. 5 is a cross section view, partly in phantom, of the continuous cylindrical wood pulp refiner of FIG. 1 taken through line 4—4 of FIG. 1 showing the housing open to provide access to the refiner plates.
Figure 6:
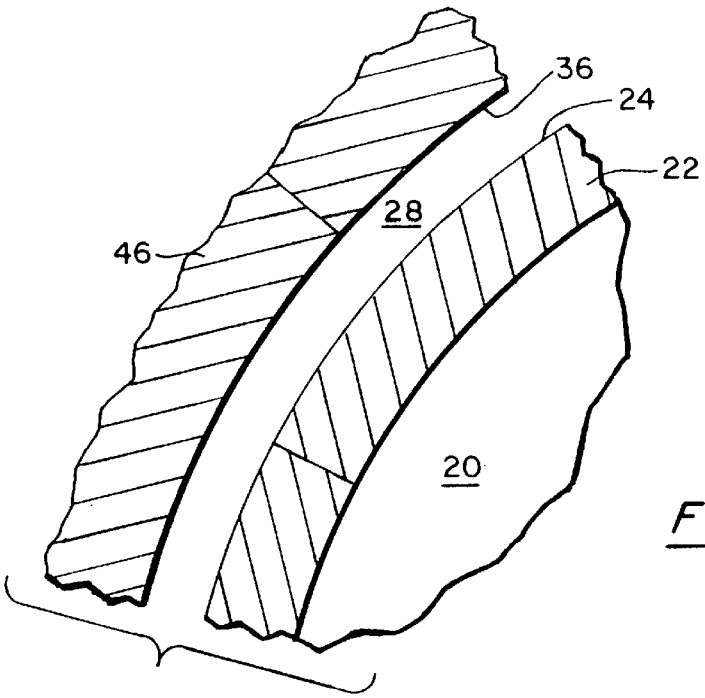
FIG. 6 is an enlarged view of area A of FIG. 4.

With reference to the drawings wherein like numerals represent like parts throughout the several figures, a continuous cylindrical wood pulp refiner in accordance with the present invention is generally designated by the numeral 10. The refiner comprises a substantially cylindrical rotor 20 disposed in a housing 30. The rotor 20 is mounted to a shaft 12 which extends horizontally through bearings 14 mounted at either end of the housing 30. The shaft 12 is driven at one or both ends (not shown) in a conventional manner for rotation about an axis 16.

A pump (not shown) delivers a slurry of lignocellulosic feed material to the interior of the housing 30 via feed conduit 11 and inlet opening 32. At the rotor 20, the material is re-directed radially outward whereupon it moves between a first grinding face 36 on the housing 30 and a second grinding face 24 on the rotor 20. The first grinding face 36 is juxtaposed to the second grinding face 24 so as to define a refining gap 28 therebetween. Refined fibers emerge from the discharge end of the refining gap 28 and are discharged from the housing 30 through a discharge opening 34 and a discharge conduit 13. The flow rate through the housing is determined by the differential pressure across the length of the rotor 20. The pump is sized to provide the proper differential pressure for each length rotor.

Figure 7:
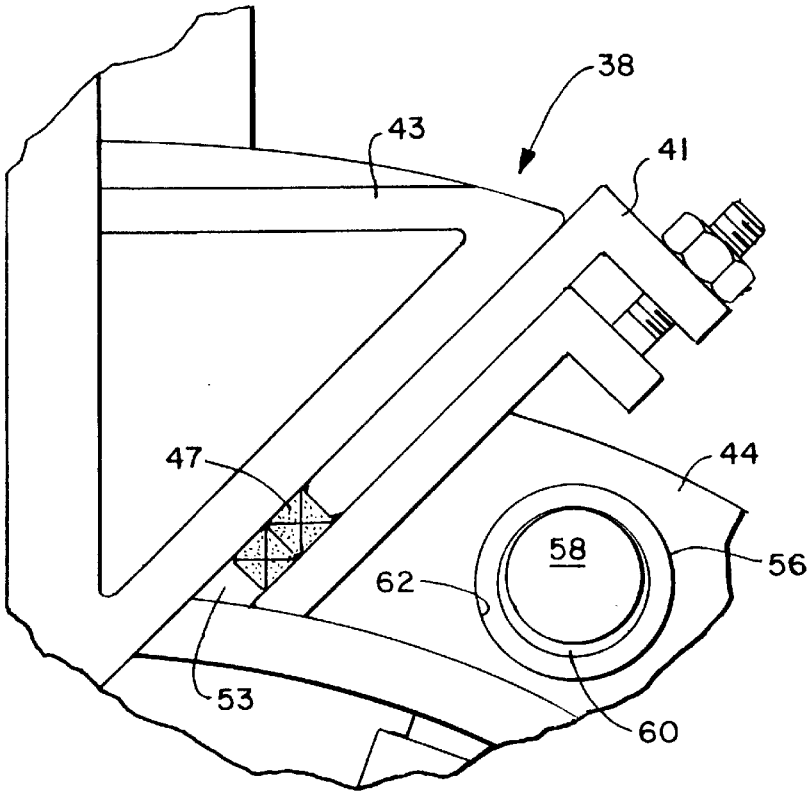
FIG. 7 is an enlarged view of area B of FIG. 4.
Figure 8:
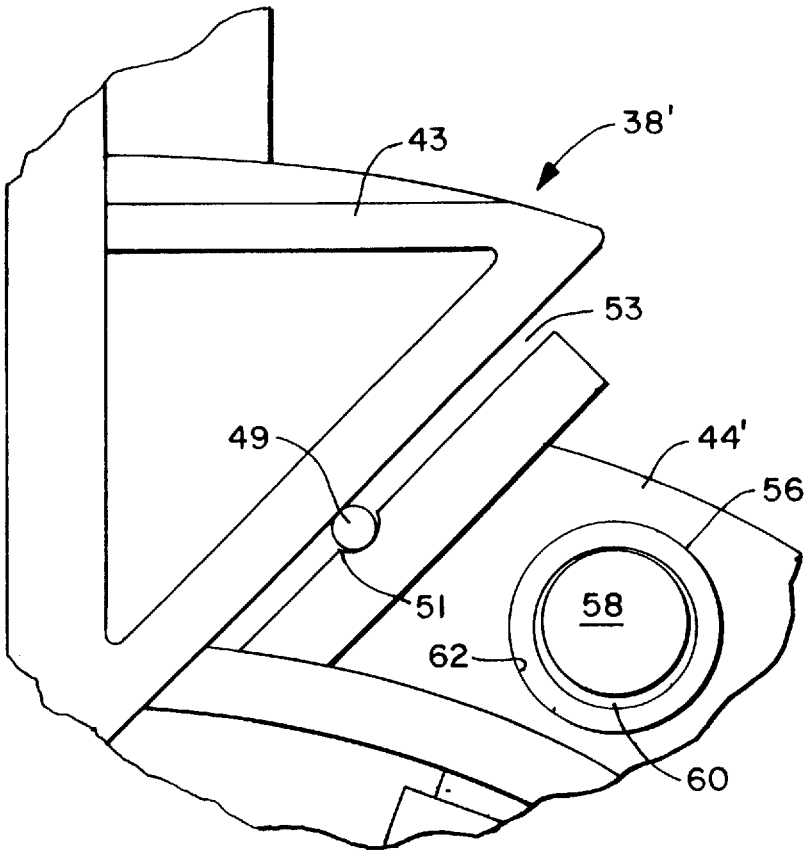
FIG. 8 is an alternate embodiment of the means for sealing the holder portion to the positioning member.

The housing 30 is comprised of a plurality of structural members 38. The members 38 are mounted together to define a pair of shells 40, 42. Each member 38 has a pair of wedge-shaped positioning members 43 and a radially movable holder portion 44. In the embodiment shown in FIG. 7, packing 47 is compressed by a packing compressor 41 to seal the holder portion 44 to the positioning members 43. In the alternative embodiment shown in FIG. 8, an O-ring 49 is disposed in a groove 51 on the holder portion 44' to seal the holder portion 44' to the positioning members 43. It should be appreciated that other appropriate means for sealing the holder portion 44 to the positioning members 43 may also be employed. The wedge-shape of the positioning members 43 ensures that the gap 53 between the holder portion 44 and the positioning members remains constant as the holder portion is moved radially towards or away from the rotor 20, At least one arcuate refining plate 46 is mounted to each holder portion 44. The refining plates 46 define the first grinding face 36. A plurality of refining plates 22 mounted on the rotor 20 define the second grinding face 24. The second grinding face 24 is exposed to the first grinding face 36 along its entire periphery. Such construction provides a maximum refining surface area for any given size refiner. The refining plates 22, 46 are mounted to the rotor 20 and the holder portions 44 in a manner which facilitates removal and replacement of the refiner plates 22, 46 when their surfaces have become worn. For example, the refiner plates 46 may be mounted by bolts 48 to the holder portions 44.

Each shell 40, 42 is pivotally mounted to the refiner base 50 such that the shells 40, 42 may be pivoted away from each other to provide access to the interior surface for changing the refiner plates 22, 46. The shells 40, 42 encompass the packing/seal 52, 54 for the inlet and outlet conduits 11, 13 and may be disengaged from the seals 52, 54 without disturbing the packing. In an embodiment for smaller refiners (not shown), the shells are mounted together and the housing slides off as a unit to provide access to the plates.

The refining gap 28 can be adjusted to compensate for wear of the plates 22, 46 or to adjust the motor load of the rotor 20. In a preferred embodiment, each holder portion 44 has a pair of cam surfaces such as bores 56 which are parallel to the shaft axis 1 6 and adjacent to each end portion 45, 45' of the holder portion 44. The cam lobe portion 60 of a cam shaft 58 is disposed in each bore 56. Rotating the cam shaft 58 causes the cam portion 60 to engage the surface 62 of the bore 56 thereby moving the holder portion 44 radially towards or away from the rotor 20. The amount of gap adjustment required to compensate for wear of the plates 22, 46 is less than that required for conical refiners. Consequently, the refiner plates 22, 46 do not need to be replaced as often as do those for a conical refiner.

An end portion 64 of each cam shaft 58 extends longitudinally outward through an orifice 66 in the housing 30. A toothed gear 68 is mounted on the segment 65 of each end portion 64 which is exterior to the housing 30. A first chain, cogbelt, or similar apparatus 72 engages the teeth 70 of each gear 68 mounted to the cam shafts 58 which are disposed in the first shell 40 and a second chain, cogbelt, or similar apparatus 74 engages each gear 68' mounted to the cam shafts which are disposed in the second shell 42. A gear 68' mounted on a cam shaft 58 disposed in the first shell 40 engages a gear 68' mounted on a cam shaft 58 disposed in the second shell 42. A gear motor 76 actuates movement of one of the chains 74 wherein the movement of all of the cam shafts 58 is coordinated to synchronize movement of all of the holder portions 44 to uniformly adjust the refining gap 28. A cover 78 is disposed over the gears 68 and chains 72, 74 for personnel safety and to protect the gears 68 and chains 72, 74 from damage. It should be appreciated that hydraulic pistons or other means may be utilized to move the holder portions 44.

Figure 9:
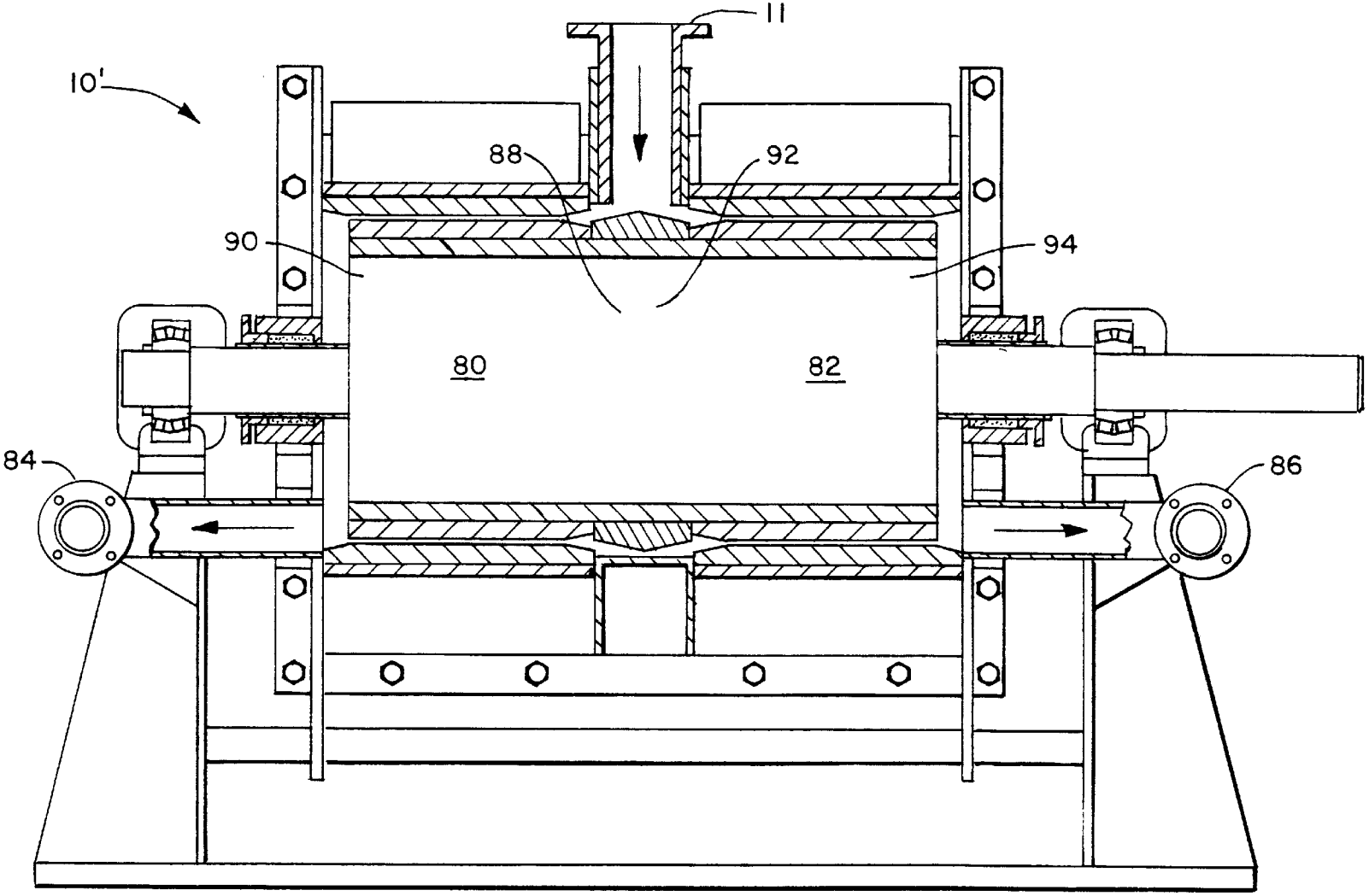
FIG. 9 is an alternate embodiment of the continuous cylindrical wood pulp refiner of FIG. 1.

A continuous cylindrical wood pulp refiner 10' may comprise an elongated cylinder with two rotor portions 80, 82 which are either integral or joined together at 88, 92, as shown in FIG. 9. Feed material is delivered to the mid line of the joined rotor portions 80, 82 via the feed conduit 11, the feed material is re-directed axially outward and moves along the first and second rotor portions 80, 82, and is discharged from the outer end 90, 94 of each refiner portion 80,82 through the discharge openings 84, 86. The thrust developed by the differential pressure across the length of the first rotor portion 80 is therefore directed oppositely to the thrust developed by the differential pressure across the length of the second rotor portion 82. Consequently, the thrust developed by the first refiner portion 80 cancels the thrust developed by the second refiner portion 82.

Characteristics of the continuous cylindrical wood pulp refiner 10 and the double continuous cylindrical wood pulp refiner 10' are compared to characteristics of a twin disk refiner in Table 1. For example, a continuous cylindrical wood pulp refiner 10 having a length of fifteen (15) inches has a plate area equivalent to a twenty-six (26) inch diameter twin disk refiner. A continuous cylindrical wood pulp refiner 10 operating at a speed of 900 RPM will produce wood pulp of comparable quality to that produced by a twin disk refiner of the same diameter operating at 1,200 RPM. Therefore, no-load should be lower making a refiner in accordance with the subject invention more efficient than a comparable twin disk refiner. In addition, the power required to operate the refiner 10 is lower than that required to operate comparable conical refiners.

TABLE 1

| | Twin Disk | Cylindrical Refiner | Double Cylindrical Refiner |
|---|---|---|---|
| Diameter (inches) | 20 | 20 | 20 |
| Axial Length (inches) | Not Applicable | 15 | 30 |
| Refining Area | 20" Twin Disk | Equivalent to 26" Twin Disk | Equivalent to 38" Twin Disk |
| Refining Path Length (inches) | 5 | 15 | 15 |
| Average Bar Velocity | $V_1$ | $V_2 = V_1$ | $V_3 = V_1$ |
| Speed (RPM) | 1200 | 900 | 900 |
| No Load Power | $P_1$ | $P_2 << P_1$ | $P_3 < P_1$ |
| Thrust Load | $T_1$ | $T_2 < T_1$ | $T_3 << T_1$ |

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner for mechanically treating fibrous slurry, comprising:

means for forming a first grinding face comprising a plurality of refining plates;

a housing disposed around said means for forming a first grinding face, said housing having inlet means for continuously receiving a fibrous slurry, outlet means for continuously discharging a refined slurry, and mounting means for mounting said refining plates, said mounting means comprising a plurality of holder portions, each of said holder portions comprising first and second bores, each of said bores having a surface, wherein at least one of said refining plates is mounted to each of said holder portions;

a plurality of cam shafts, each of said cam shafts having a cam portion, a said cam portion of a said cam shaft being disposed in each of said bores wherein said cam portion is engageable with said surface;

a cylindrical rotor member situated within said housing and having a surface forming a second grinding face, said second grinding face being juxtaposed with said first grinding face along the entire periphery of said second grinding face, said first and second grinding faces defining a generally annular refining gap therebetween in fluid communication with said inlet and said outlet; and a horizontal shaft penetrating the housing and connected to the rotor member for spinning the rotor about a horizontal rotation axis, wherein each of said bores is substantially parallel to said axis;

wherein each of said refining plates of said first grinding face is positionable to adjust said refining gap.

2. The refiner of claim 1 wherein said housing comprises a plurality of structural members defining first and second shells.

3. The refiner of claim 2 further comprising base means, each of said shells being pivotally mounted to said base means wherein said first and second shells may be pivoted away from each other to provide access to said first and second grinding faces.

4. The refiner of claim 1 wherein said housing comprises means for mounting said refining plates.

5. The refiner of claim 4 wherein said means for mounting comprises a plurality of holder portions, wherein at least one of said refining plates is mounted to each of said holder portions.

6. The refiner of claim 1 wherein said housing further comprises a plurality of stationary wedge-shaped positioning members with consecutive positioning members having parallel sides and each of said holder portions comprises opposite ends, a said positioning member being disposed adjacent each of said ends, said means for mounting further comprising seal means for providing a sliding fluid seal between each said positioning member and a respective one of said ends.

7. The refiner of claim 1 further comprising a plurality of gears and wherein each of said cam shafts has an end portion extending exteriorly through an orifice in said housing, each of said gears being mounted on a said end portion for rotating a respective cam shaft.

8. The refiner of claim 7 wherein a first subset of said gears defines a first gear group and second subset of said gears comprises a second gear group wherein all of said gears are a member of either said first or second gear group and wherein said refiner further comprises first and second engagement means, wherein said first engagement means engages said first gear group for rotating all of said gears in said first gear group and said second engagement means engages said second gear group for rotating all of said gears in said second gear group.

9. The refiner of claim 8 further comprising motor means engaged with said first engagement means and wherein a first of said gears is a member of said first gear group and a second of said gears is a member of said second gear group, said first gear engaging said second gear, wherein actuating said motor means causes said first engagement means to rotate said first gear group, rotating said first gear causes said second gear to rotate, rotating said second gear causes said second engagement means to rotate said second gear group, whereby each of said cam portions engage each of said surfaces of said bores causing said holder portions to move radially relative to said shaft.

10. The refiner of claim 9 wherein said first and second engagement means each comprise a chain.

11. The refiner of claim 1 wherein said means for forming a second grinding face comprises a plurality of refining plates.

12. The refiner of claim 1 wherein said rotor member comprises first and second rotor sections, wherein said first and second rotor sections have oppositely disposed first and second ends, said first end of said first rotor section being mounted to said first end of second rotor section, said inlet means being disposed adjacent said first ends of said first and second rotor sections, and wherein said outlet means comprises first and second outlets disposed adjacent said second ends of said first and second rotor sections.

13. A refiner for mechanically treating fibrous slurry, comprising:

means for forming a first substantially cylindrical concave grinding face defining an axis, said means for forming said first grinding face comprising a plurality of refining plates;

a housing disposed around said means for forming said first grinding face, said housing comprising a plurality of holder portions having radially inner and outer sides, each holder portion having at least one of said refining plates mounted on the radially inner side and a cam surface at the radially outer side;

a cam lobe engaged with said cam surface for moving the holder portion radially;

a cylindrical rotor member situated within said housing coaxially with said first grinding face, and having a surface forming a second substantially cylindrical concave grinding face, said second grinding face being juxtaposed with said first grinding face, said first and second grinding faces defining a generally annular refining gap therebetween; and a shaft penetrating the housing and connected to the rotor member for spinning the rotor about a rotation axis being on said axis;

wherein each of said refining plates of said first grinding face is positionable to adjust said refining gap.

14. The refiner of claim 13 wherein the cam surface in a bore and each cam lobe is carried by a cam shaft having an end portion driven externally of the housing.

15. The refiner of claim 14 further comprising a plurality of gears, each of said gears being mounted on a said end portion, a first subset of said gears defining a first gear group and second subset of said gears defining a second gear group, wherein all of said gears are a member of either the first or second gear group, a first of said gears being a member of said first gear group and a second of said gears being a member of said second gear group, said first gear engaging said second gear.

16. The refiner of claim 15 wherein said refiner further comprises motor means and first and second engagement means, wherein said first engagement means engages said first gear group and said second engagement means engages said second gear group, said motor means engaging said first engagement means, wherein actuating said motor means causes said first engagement means to rotate said first gear group, rotating said first gear causes said second gear to rotate, rotating said second gear causes said second engagement means to rotate said second gear group, whereby each of said cam portions engage each of said surfaces of said bores causing said holder portions to uniformly move radially relative to said shaft.

17. The refiner of claim 13 comprising:

an inlet at one axial end of the housing, an outlet at the other axial end of the housing, and means for continuously pumping a flow of fibrous slurry through the inlet, housing, and outlet, at a predetermined flow rate.

18. The refiner of claim 17 wherein the housing comprises a plurality of radially movable holder portions, each having radially inner and outer sides, said first grinding face comprises arcuate grinding plates mounted on the inner side of said holder portions, and means cooperating with the outer surface of the holder portions, for adjusting the holder portions radially, thereby varying said gap.

19. The refiner of claim 18, including engagement means cooperating with said means for adjusting the holder portions, for radially moving all said holder portions simultaneously a substantially equal distance.

20. The refiner of claim 13, wherein the second grinding face is juxtaposed with said first grinding face along the full axial extension of said first grinding face.

* * * * *